US006502374B1

(12) United States Patent
Llorca Chulia

(10) Patent No.: US 6,502,374 B1
(45) Date of Patent: Jan. 7, 2003

(54) DEVICE FOR ARRANGING GELATINE CAPSULES FOR LOADING IN BLISTER PACKS

(76) Inventor: Francisco Javier Llorca Chulia, Virgen del Rosario, 30-2°, Sedavi (ES), E-46910

( * ) Notice: Subject to any disclaimer, the term of this patent is extended or adjusted under 35 U.S.C. 154(b) by 0 days.

(21) Appl. No.: 09/593,714

(22) Filed: Jun. 14, 2000

(30) Foreign Application Priority Data

Jun. 16, 1999 (ES) ..... 9901336

(51) Int. Cl.[7] ..... B65B 35/30

(52) U.S. Cl. ..... 53/539; 53/560; 53/247; 53/248

(58) Field of Search ..... 53/539, 542, 543, 53/560, 241, 246, 248, 247

(56) References Cited

U.S. PATENT DOCUMENTS 1,675,741 A * 7/1928 Waring
3,545,164 A * 12/1970 Middleton
4,398,578 A * 8/1983 Walters et al.
4,693,057 A * 9/1987 Rittinger et al. ..... 53/539
4,884,602 A * 12/1989 Yamamoto et al.

FOREIGN PATENT DOCUMENTS

| | | |
|---|---|---|
| ES | 278428 | 9/1984 |
| ES | P9801285 | 6/1998 |

* cited by examiner

*Primary Examiner*—Eugene Kim
*Assistant Examiner*—Sameh Tawfik
(74) *Attorney, Agent, or Firm*—Richard M. Goldberg

(57) ABSTRACT

A device in which a set of capsules previously filled with a specific amount is positioned in a set of cavities arranged in plates, the plates assuming two positions, one for receiving the capsules in correspondence with a capsule-filling device, and the other for unloading these, the second operation being performed with the plates in an extended position in respect of the device frame, and the plates have two parts, an upper one which houses the capsules and a lower one which retains these. In the unloading position the lower plates align with the upper ones, thus allowing the capsules to drop through to arrange the gelatine capsules in blister packs.

5 Claims, 5 Drawing Sheets

DEVICE FOR ARRANGING GELATINE CAPSULES FOR LOADING IN BLISTER PACKS

BACKGROUND OF THE INVENTION

The present invention relates to a device for arranging gelatine capsules for loading in blister packs.

The technical sector involved in this patent is in the pharmaceutical industry, being that of the arrangement of products made in low production volumes for packaging, and in particular of gelatine capsules of the sort which contain pharmaceutical specifics.

Statement of the prior state of the art. ES U278428 consists of a device for loading gelatine capsules of the sort that are filled with pharmaceutical specifics, as stated above.

The technique of filling capsules, apart from industrial processes, can be performed by means of simple apparatus like the one mentioned.

ESP9801285 consists of a surface for holding empty hard gelatine capsules and the use of said surface with the capsules inserted, including the arrangement and use of a support for carrying out loading and capsule-filling in small apparatus like the one previously mentioned.

After having been filled and closed, the capsules have to be packed. This packing can be carried out by loose means, in a bottle with the capsules loose. This may entail problems both with the number of capsules provided, and with monitoring the dosage. The solution for this necessarily involves packaging in blister packs, which means the dosage can be divided by periods, also facilitating user control both of the number of capsules contained in the pack, and the number of these that have been consumed. The technology for blister packing of capsules is divided into manual and automatic means. The automatic ones requires large-scale production and are used by the big commercial laboratories. Manual capsule-filling is carried out at chemists' and small laboratories. It is here that the need met by this device arises. The capsules are handled with the greatest asepsis: nevertheless, the arrangement of the capsules in bottles, jars or other loose presentations is less acceptable to the public than presentation in blister packs, one of whose walls is easily broken by the pressure of the same capsule from the other side. One advantage meant by this system as opposed to the other means of presentation stated above is that, apart from the capsules being isolated, and being able to be transported by groups, units, dosages, etc., it can be checked that a treatment contains the exact number of capsules that were purchased.

SUMMARY OF THE INVENTION

This invention covers a device for arranging gelatine capsules for loading these in blister packs which carries out arrangement functions prior to blistering the capsules which have previously been filled.

Starting from the capsule-filling device which is referred to in the previous patent of this same holder, n° P9801285, for a surface holding gelatine capsules, after the capsules are filled these are placed in the device by inversion. That is, the device is placed with the cavities downwards coinciding with the capsule-filling device, and this is turned over 180°. The content of the device is now the set of capsules proceeding from the first filling operation. The device is then placed on the base of the blister package made up of recesses and the plate cavities are separated so that the full capsules can fall into these recesses in an orderly fashion. This occurs because the device assembly has a mechanism which retains the capsules in the position in which these gain access to the cavities in said device, whereas when these move in order to reach the positions corresponding to the blister, the cavities open below, and the capsules are able to drop into the aforementioned blister.

BRIEF DESCRIPTION OF THE DRAWINGS

In order to make the following explanation clearer, five sheets of drawings are enclosed which represent the essence of this invention in seven figures.

DETAILED DESCRIPTION

Figure 1:
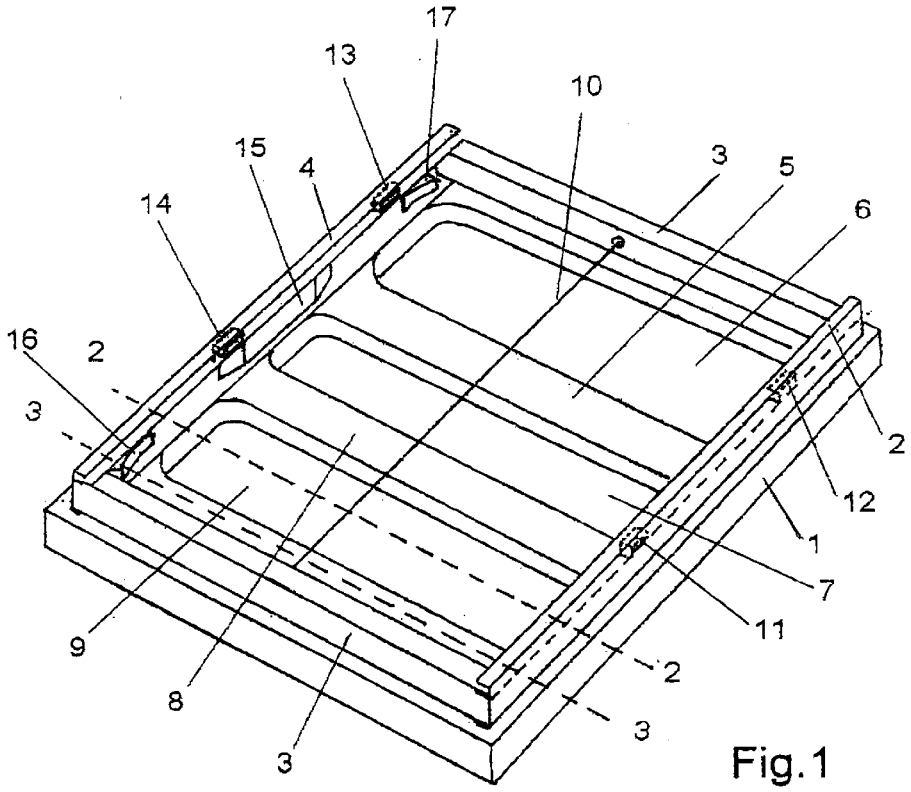
FIG. 1 illustrates a perspective view of the device frame.
Figure 2:
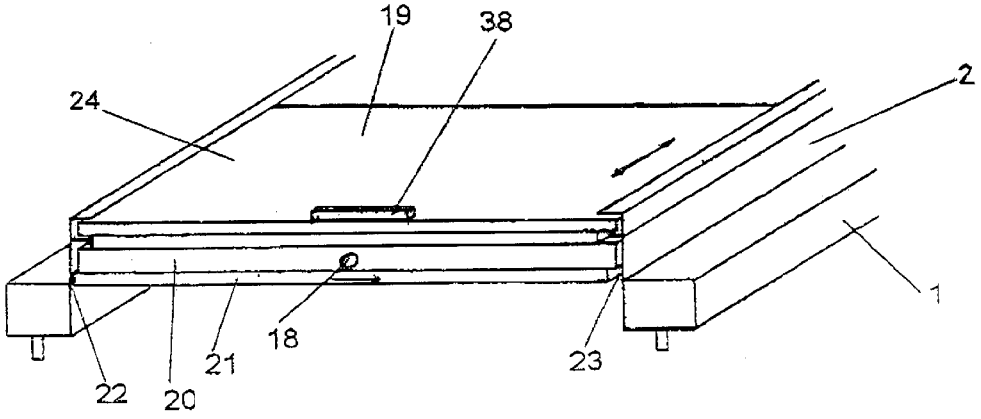
FIG. 2 illustrates a view according to a section 2—2 of FIG. 1, with the movable blocks in initial position.
Figure 3:
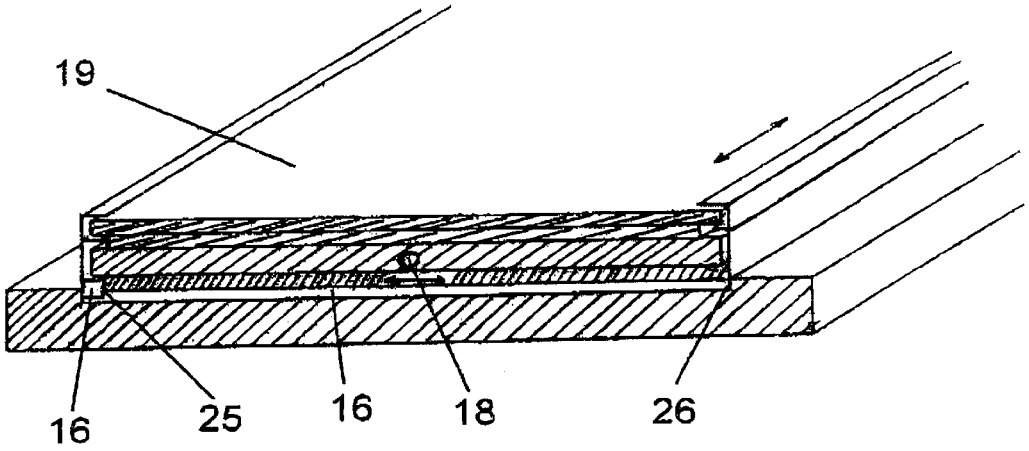
FIG. 3 shows a view according to a section 3—3 of FIG. 1, with the movable blocks, in the unloading position.
Figure 4:
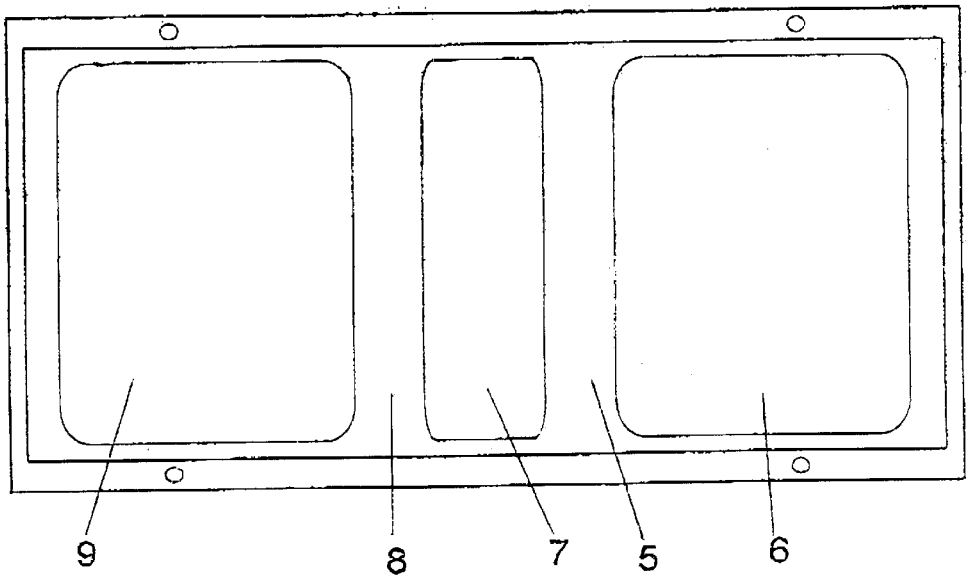
FIG. 4 illustrates a plan view of the chassis of the device.

In these figures number 1 indicates the frame, 2 a side guide, 3 the stop in the frame extension, 4 is a side guide, 5 the bottom of the frame, a crosspiece; 6 the side opening in the frame, 7 the central opening in the frame, 8 the bottom of the frame, a crosspiece; 9 the side opening in the frame, 10 the central guide, 11 a stop fixed on the guide 2, 12 a stop set on the guide 2, 13 a stop fixed on guide 4, 14 a stop fixed on guide 4, 15 the central convex wedge backing onto the side guide 4, 16 the wedge at the end backing onto side guide 4, 17 the wedge at the end backing onto side guide 4, 18 the space for the guide to go through, 19 the upper moving block, 20 the central moving block, which is joined to the upper movable block 19, 21 the lower transversal movable block, 22 the alignment of block 21 to the wall of the guide 4, 23 the side cavity, 24 the cavities in the upper movable block 19, 25 the support between the guide 16 and the movable block 21, 26 the support on the side guide 2, 27 the intermediate convex wedge on the side guide 2, 28 the convex intermediate wedge on the side guide 2, 29 the upper central plate of cavities, 30 being the lower inner plate, 31 the lower outer plate, 32 the holes in the plate 30, 33 the holes in the plate 31, 34 the holes in the central plate, 35 the wings of the lower inner plate 30, 36 the holes in the upper inner plate, 37 the holes in the upper outer plate, 38 the tabs for pulling on the plates, 39 the transversal guides between the upper and lower plates, 40 the rods or strips forming the limits to the extension of the movable blocks 19.

Explanation of one form of embodiment.

Figure 5:
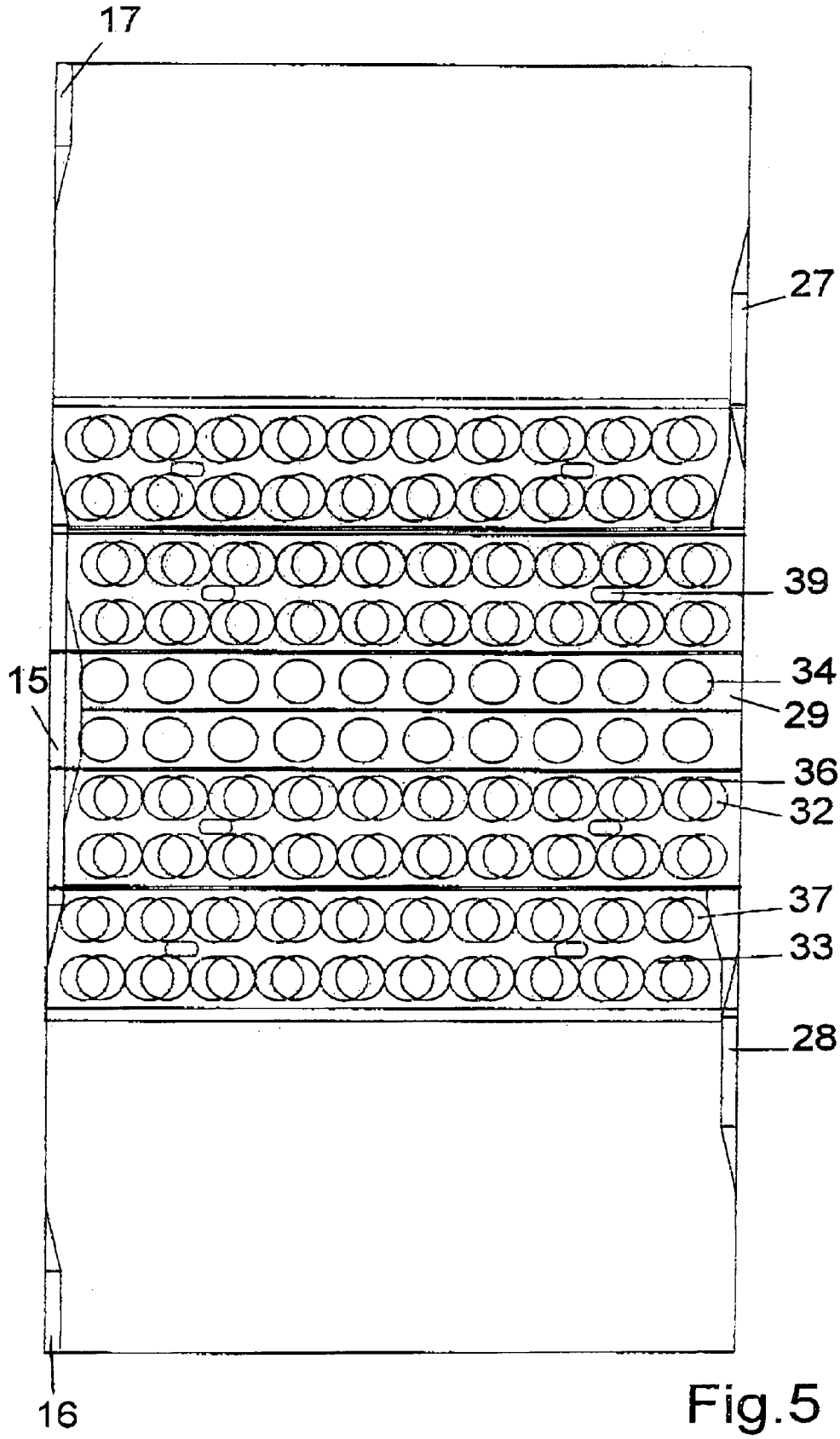
FIG. 5 shows a top view of the movable blocks and the corresponding frame with the wedges for transversal movement of the lower part of the blocks, in the initial position.
Figure 6:
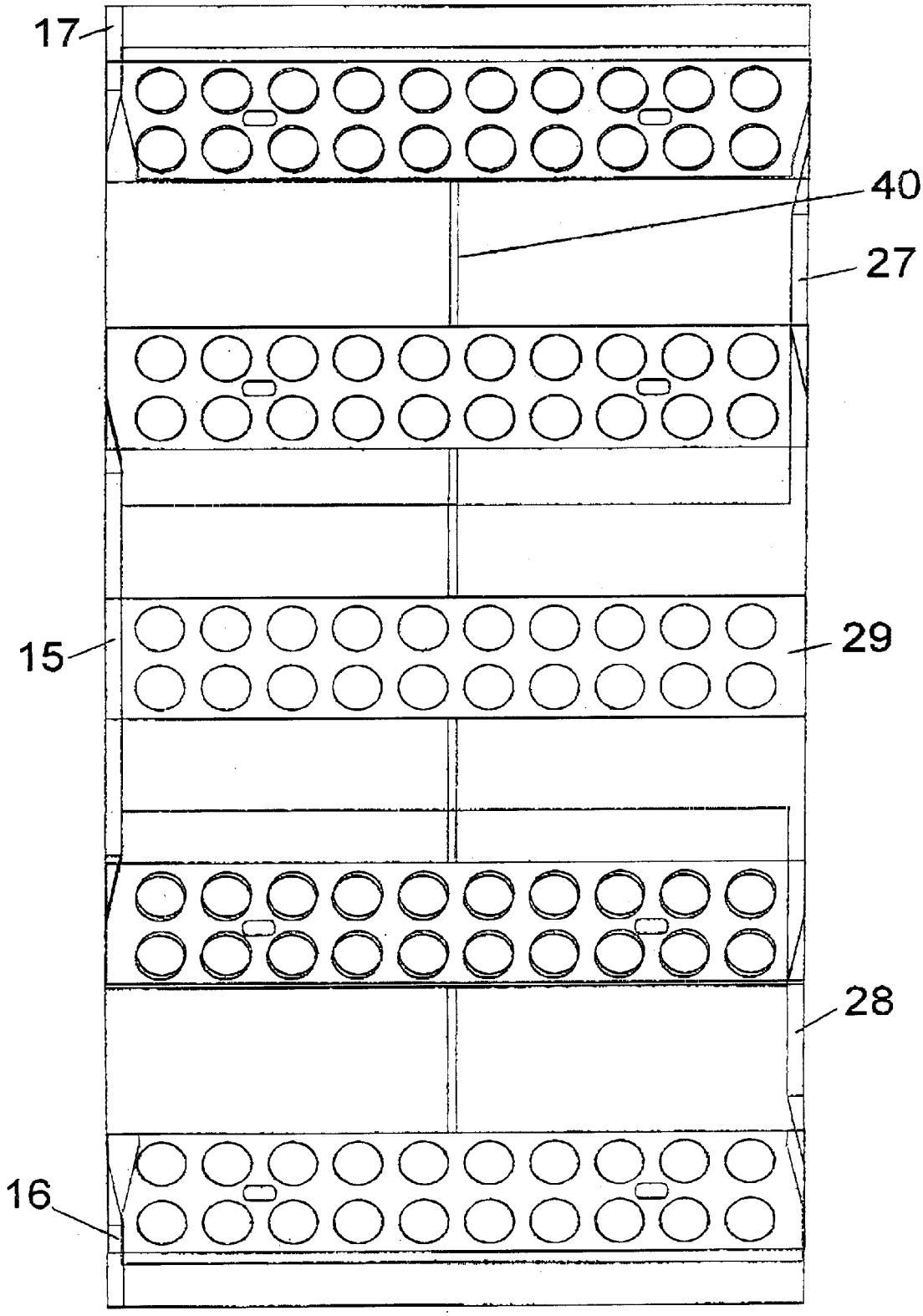
FIG. 6 shows a top view of the set of blocks in the final position.
Figure 7:
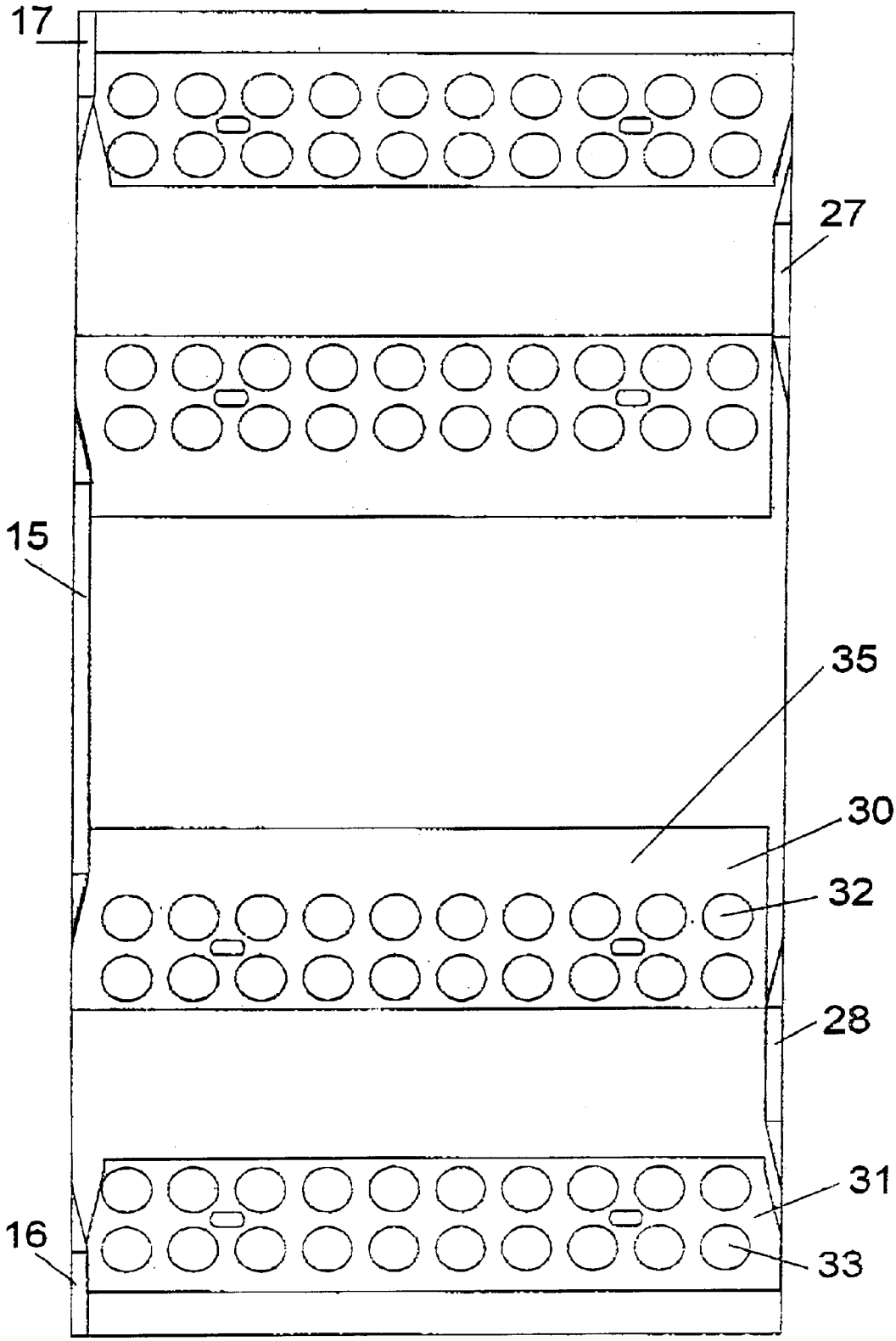
FIG. 7 illustrates a top view only of the lower part of the blocks.

The device covered in this explanation consists of a frame 1 which has guides 2 and 4 between which sets of sliding plates can move. When the plates are closed as a set, as shown in FIG. 5, these have a regular layout of all the upper holes; these coincide with the capsule holders mentioned at the beginning of this text, and this device, when placed on that capsule holder, of the same size and content, and when both are turned over 180° loads one capsule per recess or hole.

The blisters have the capsules aligned in their longitudinal dimension. This means 100 capsules can be catered for, for example, as can be appreciated from FIGS. 4 to 7.

One part of the blister, the plastic part, is placed under the device after the holes have been loaded with a single capsule per cavity. As can be appreciated from FIG. 5, the lower holes, shown in lighter strokes, are out of alignment with the upper ones. This fact, with the thickness of the upper plate formed of the parts indicated with numbers 19 and 20, determines sufficient vertical space to house said capsules.

After placing the device over the plastic base of the blister, the tabs 38 are pulled along to extend the upper plates towards the stops 3; the central plates abut with the stops 11, 12, 13 and 14 and the outer ones with said stops 3, as well as with the rods or strips 40. The effect produced by said extension due to the presence of the wedges 15, 16, 17 at the bottom of the guide 4 and, at the opposite side, that of the wedges 27 and 28 at the bottom of the guide 2, is that of aligning the holes 33–37 in the outer plates and 32–36 in the internal ones, at which point the capsules will drop neatly into the blister pack. The central one, which does not have any hole out of alignment in the bottom, held the capsules with the wings formed by the part shown as 35 of the plate 30, which, when separated to be aligned with its own holes, frees this central part which also lets its capsules drop through.

As has already been said, each block 19 is joined by a rod or strip in respect of the adjacent one, determining the maximum separation between these corresponding to the lower position which aligns the cavities with the holes of the lower movable plates 21, 30, 31.

This item is for industrial application in the production of auxiliary devices for loading capsules filled with medicine or specifics in blister packs.

What is claimed is:

1. A device for arranging gelatine capsules for loading in blister packs, comprising:

a plurality of blocks, each with cavities, each one of said cavities being defined by a hole in a top plate of said blocks and at least one lower plate which is movable with respect to the top plate, which, by means of said movement, closes or opens a communication of each cavity towards a bottom of the cavity, each one of said cavities being dimensioned to house a capsule, as well as to facilitate unloading of the capsule, said blocks including a fixed central block and movable blocks adjacent to at least one side of said fixed central block and being movable between first and second positions, the first position being an initial position corresponding to a temporary housing of the capsules, in which the capsules are placed in the device after coming from a device for filling the capsules, and the second position being a final unloading position in which the capsules reach a corresponding recess of a blister or container placed underneath the cavities, by falling through the corresponding cavities in which the capsules were held;

at least one guide which guides the movement of the blocks therealong;

at least one first member for retaining the capsules in at least some of said cavities of said fixed block in said initial position and for releasing said capsules from said at least some of said cavities of said fixed block when at least one said movable block is moved away from said first position toward said second position;

at least other ones of the cavities being arranged in the movable blocks in the initial position such that the capsules coming from a capsule-filling device can be retained in the cavities in the blocks;

a mechanism by which, through movement of the blocks, arranges said at least other ones of the cavities to release the capsules therein, when the blocks are moved to the final unloading position; and at least one member for taking the blocks back to the initial position from the final position.

2. A device according to claim 1, wherein the at least one first member includes at least one wing of at least one inner lower plate which overlaps the holes of a central upper plate of the central block in said initial position.

3. A device for arranging gelatine capsules for loading in blister packs, comprising:

a plurality of blocks, each with cavities, each one of said cavities being defined by a hole in a top plate of said blocks and at least one lower plate which is movable with respect to the top plate, which, by means of said movement, closes or opens a communication of each cavity towards a bottom of the cavity, each one of said cavities being dimensioned to house a capsule, as well as to facilitate unloading of the capsule, said blocks being movable between first and second positions, the first position being an initial position corresponding to a temporary housing of the capsules, in which the capsules are placed in the device after coming from a device for filling the capsules, and the second position being a final unloading position in which the capsules reach a corresponding recess of a blister or container placed underneath the cavities, by falling through the corresponding cavities in which the capsules were held;

at least one guide which guides the movement of the blocks therealong, and said at least one guide includes two parallel, spaced apart, side guides, and a transverse dimension of each lower movable plate is slightly less than a distance between the two side guides; and at least one first member for retaining the capsules in at least some of said cavities in said initial position;

at least other ones of the cavities being arranged in the blocks in the initial position such that the capsules coming from a capsule-filling device can be retained in the cavities in the blocks;

a mechanism by which, through movement of the blocks, arranges said at least other ones of the cavities to release the capsules therein, when the blocks are moved to the final unloading position, and the mechanism includes:

a transverse guide set between each upper plate and corresponding lower plate; and wedges which are set out in the side guides, and which determine a relative transverse position of the lower movable plate of each of said blocks; and at least one member for taking the blocks back to the initial position from the final position.

4. A device according to claim 1, wherein the mechanism includes an arrangement of stops set out on the side guides, for determining limits of movement of the blocks along the side guides.

5. A device for arranging gelatine capsules for loading in blister packs, comprising:

a plurality of blocks, each with cavities, each one of said cavities being defined by a hole in a top plate of said blocks and at least one lower plate which is movable with respect to the top plate, which, by means of said movement, closes or opens a communication of each cavity towards a bottom of the cavity, each one of said cavities being dimensioned to house a capsule, as well as to facilitate unloading of the capsule, said blocks being movable between first and second positions, the first position being an initial position corresponding to a temporary housing of the capsules, in which the capsules are placed in the device after coming from a device for filling the capsules, and the second position being a final unloading position in which the capsules reach a corresponding recess of a blister or container placed underneath the cavities, by falling through the corresponding cavities in which the capsules were held, and each block is joined with respect to an adjacent block by a coupling including one of a rod and strip, which determines that a greatest separation between said adjacent blocks corresponds to a position which aligns the holes in the upper plates with holes in the lower moving plates;

at least one guide which guides the movement of the blocks therealong; and at least one first member for retaining the capsules in at least some of said cavities in said initial position;

at least other ones of the cavities being arranged in the blocks in the initial position such that the capsules coming from a capsule-filling device can be retained in the cavities in the blocks;

a mechanism by which, through movement of the blocks, arranges said at least other ones of the cavities to release the capsules therein, when the blocks are moved to the final unloading position, and; and at least one member for taking the blocks back to the initial position from the final position.

* * * * *